US005147275A

United States Patent [19]

Staniszewski

[11] Patent Number: 5,147,275

[45] Date of Patent: Sep. 15, 1992

[54] AUTOMATIC PAPER FOLDER

[75] Inventor: Tadeusz Staniszewski, Budd Lake, N.J.

[73] Assignee: Hunt Holdings, Inc., Wilmington, Del.

[21] Appl. No.: 817,078

[22] Filed: Jan. 6, 1992

[51] Int. Cl.[5] ..... B65H 45/04

[52] U.S. Cl. ..... 493/416; 493/419

[58] Field of Search ..... 493/416, 417, 419–421, 493/436, 442, 460–462, 405; 270/45

[56] References Cited

U.S. PATENT DOCUMENTS

| | | | |
|---|---|---|---|
| 2,725,228 | 11/1955 | Seward | 270/61 |
| 3,995,849 | 12/1976 | Kistner | 270/68 A |
| 4,518,381 | 5/1985 | Wakatski | 493/444 |
| 4,573,672 | 3/1986 | Lehmann | 270/45 |
| 4,619,101 | 10/1986 | Havey, Jr. et al. | 53/117 |
| 4,647,029 | 3/1987 | Ohmori | 270/45 |
| 4,701,233 | 10/1987 | Beck et al. | 156/217 |
| 4,717,134 | 1/1988 | Iida et al. | 270/39 |
| 4,816,108 | 3/1989 | Beck et al. | 156/356 |
| 4,834,699 | 5/1989 | Martin | 493/421 |
| 4,842,574 | 6/1989 | Noble | 493/461 |
| 4,850,945 | 7/1989 | Whittenberger | 493/14 |
| 4,898,570 | 2/1990 | Luperti et al. | 493/420 |
| 4,917,662 | 4/1990 | Gombault | 493/462 |

*Primary Examiner*—Bruce M. Kisliuk
*Assistant Examiner*—Jack Lavinder
*Attorney, Agent, or Firm*—Synnestvedt & Lechner

[57] ABSTRACT

Apparatus for automatically folding one or more sheets of paper into three substantially equal sections for later insertion into a mailing envelope. Rollers are used to introduce the sheet into a guide which guides the leading edge of the sheet back against an upstream line in the same sheet, where a first fold is to be made. Upon further operation, the lead edge of the sheet forces the upstream line in the sheet into a nip between two rollers, which then seize, pass and fold the sheet along the upstream line with the leading edge of the sheet still within the fold. Still further operation pulls the remaining loop and the remaining upstream portion of the sheet into the roller nip to form the desired second fold. The guide has a radially-inwardly biased input portion which, when the leading edge strikes the upstream portion of the sheet, moves radially outward, and later returns inwardly under spring pressure to assist in urging the leading edge of the sheet, and the upstream line in the sheet, into the folding roller nip.

7 Claims, 7 Drawing Sheets

AUTOMATIC PAPER FOLDER

FIELD OF THE INVENTION

This invention relates to apparatus for automatically folding paper-like sheets of material, and has special application to such apparatus for folding one or more paper sheets into three sections in preparation for mailing in an envelope.

BACKGROUND OF THE INVENTION

There are many instances in which sheets of paper are to be folded for insertion into envelopes for subsequent mailing. In a specific application to which this invention is especially applicable, it is desirable to fold one or several letter size sheets into three equal sections for insertion into a standard mailing envelope. It is often important from the viewpoint of efficiency, time saving and minimizing of costs to effect such folding as rapidly and easily as possible.

A variety of machines are known which can accomplish such folding automatically when fed sequentially with individual sheets or sets of sheets of paper. However, such machines tend to be rather complex and expensive, and hence are not best suited for ordinary light office use.

Accordingly, an object of this invention is to provide a new and useful apparatus for folding sheets of paper-like materials.

Another object is to provide such apparatus which is relatively simple, inexpensive and easy to use.

SUMMARY OF THE INVENTION

In accordance with this invention, folder apparatus for folding sheets of paper-like material is provided which comprises roller means for advancing a sheet, and guide means for guiding the leading edge of the advancing sheet along a path turning back upon itself in a loop, so that the leading edge of the sheet impinges a transverse line in an upstream portion of the sheet; the roller means provides a nip extending along that line, whereby further operation causes the leading edge of the sheet to form a linear dimple in the sheet which extends along the line and which then embraces the leading edge of the sheet. Upon further operation, the leading edge of the sheet remains within, and travels with, the linear dimple as it passes into and through the nip, to form a first creased fold in the sheet extending along the line and containing the leading edge of the sheet. With continued operation of the roller means, the portion of the sheet still extending in a loop in the guide passes through the nip to form a second creased fold, thereby folding the sheet into three sections.

Preferably the first fold line is located about two-thirds of the way from the leading edge of the sheet to the trailing edge of the sheet so that the sheet is folded into thirds, as suits many mailing applications. More than one sheet at a time may be folded in this manner.

In order to assure that the leading edge of the sheet will force the transverse line in the sheet into the folding nip and then remain within the consequent fold formed by the nip, in a preferred embodiment a portion of the guide initially passed by the leading edge of the sheet is spring-mounted and biased inwardly of the loop, so as to move outwardly when the sheet has advanced into and around the guide means into contact with the transverse line in the upstream portion of the sheet; it thereafter moves back radially inwardly of the guide to assist in forcing the line in the sheet into and through the adjacent folding nip, as desired.

Also in a preferred embodiment, the roller means for advancing the sheet is automatically turned on in response to insertion of the sheet into the folder and turned off by exiting of the sheet from the folder. Preferably this is done by means of a pivoted mechanical sensor which rotates in one direction in response to travel of the paper into the folder, thereby actuating a microswitch to turn on the folder motor; is held in this position by the sheet until the sheet leaves the folder; and, upon exit of the sheet, reverts to its rest position, thereby permitting the microswitch to return to its original position, to shut off the folder motor.

BRIEF DESCRIPTION OF FIGURES

These and other objects and features of the invention will be more readily understood from a consideration of the following detailed description, taken with the accompanying drawings, in which.

DETAILED DESCRIPTION OF PREFERRED EMBODIMENT

Figure 1:
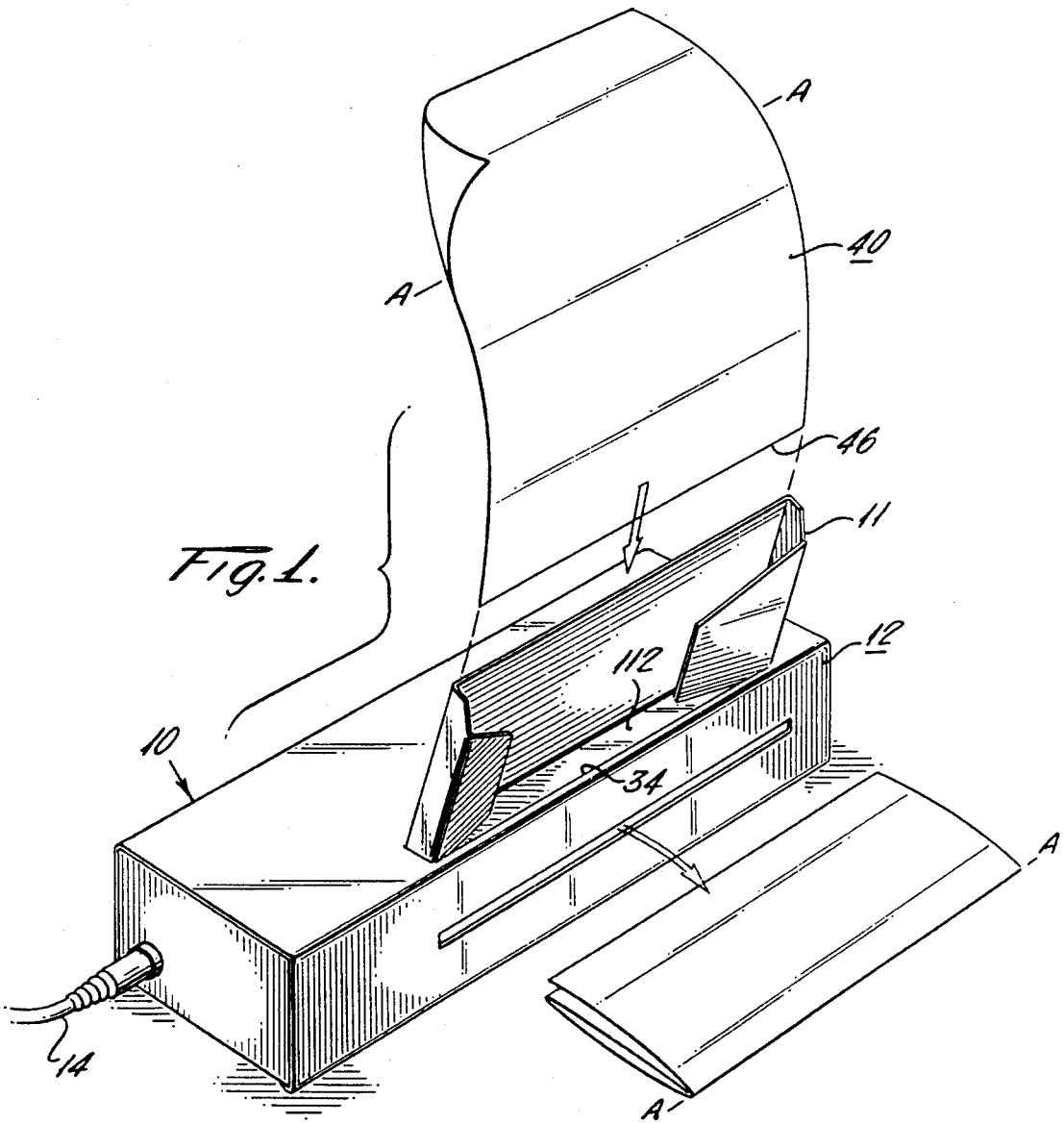
FIG. 1 is a perspective view of the outside of a preferred embodiment of the folder of the invention.
Figure 2:
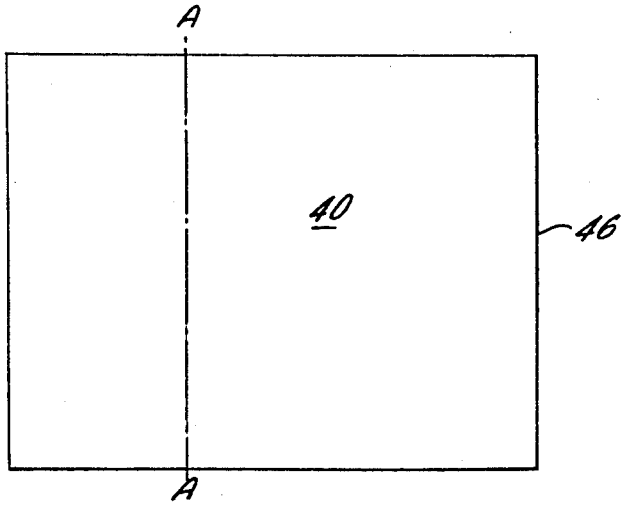
FIG. 2 is a plan view of a sheet to be folded by the folder of FIG. 1, showing the first fold line A.
Figure 4:
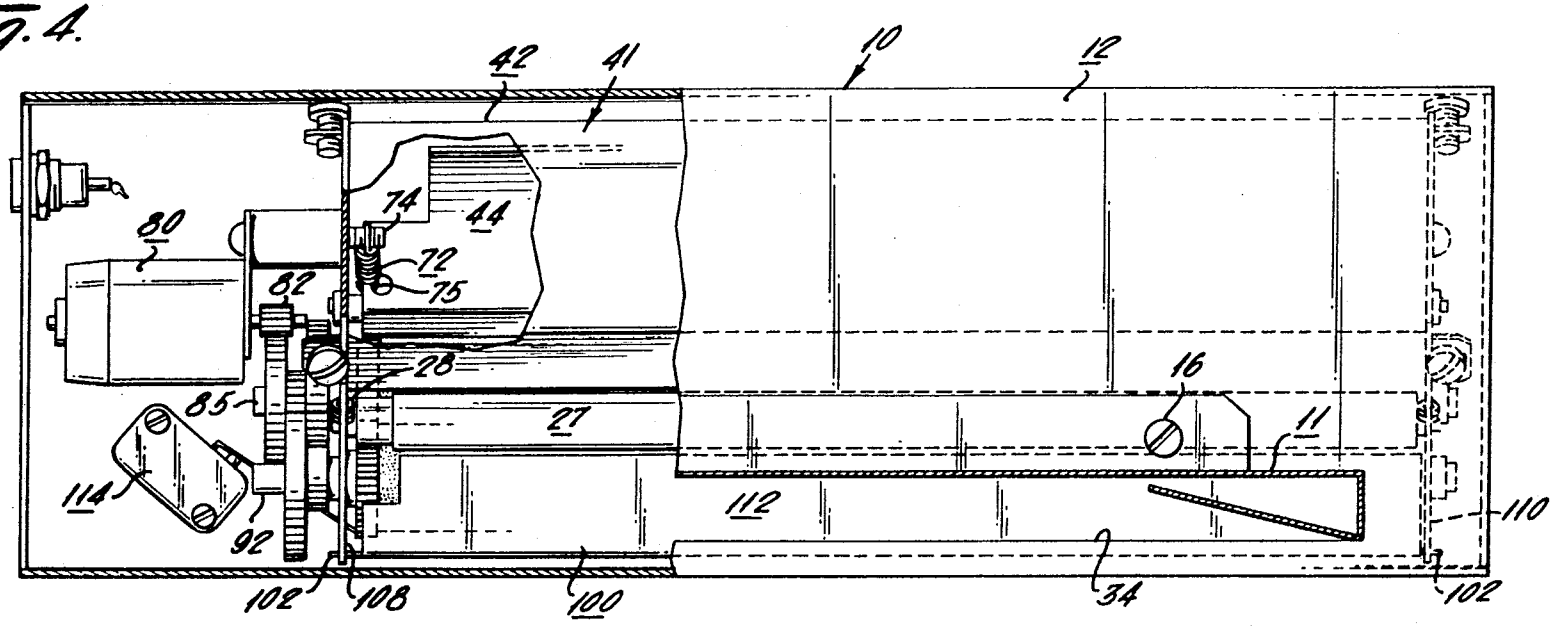
FIG. 4 is a plan view of the folder of FIG. 3, with parts broken away.
Figure 3:
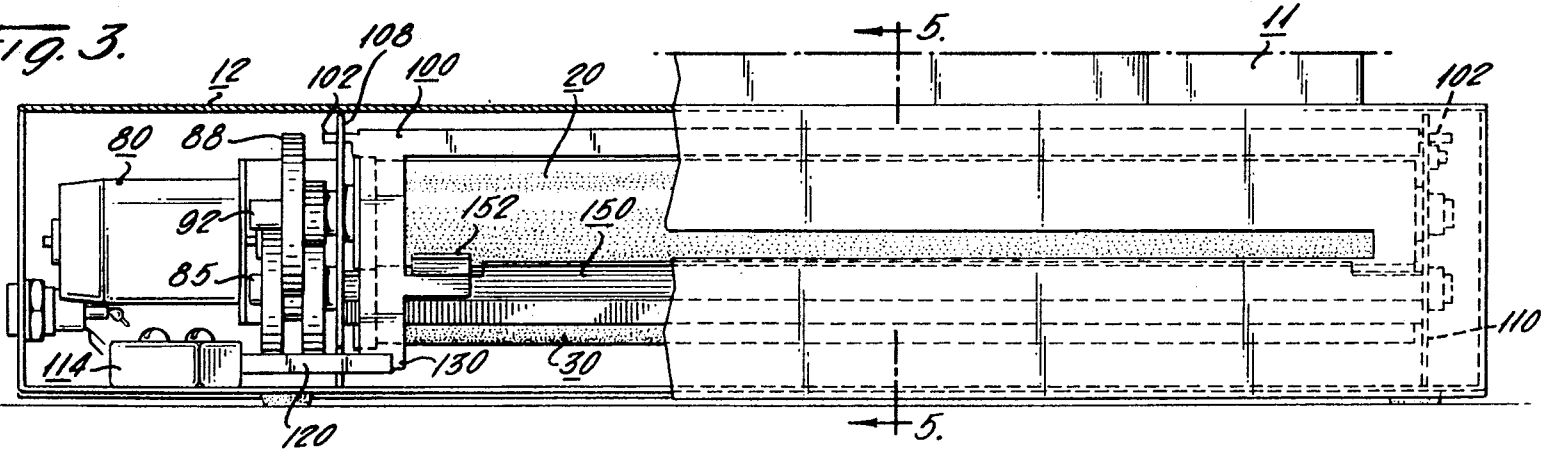
FIG. 3 is a front elevational view of the folder of FIG. 1, with portions broken away.

Referring now to the preferred embodiment of the invention shown in the drawings, the folder 10 comprises, generally, a channel-shaped paper inlet guide 11, a folder housing 12 and its contents, and an electrical line cord 14 for connection to a utility power line, e.g. to a source of 110 volts AC by way of a 12-volt DC converter. The guide 11 is mounted on the top of the folder housing 12 by means of screws 16.

Roller means are provided in the housing 12 comprising an input drive roller 20, an input idler roller 27 extending parallel to drive roller 20 and biased against it by spring 28 to form an inlet nip 24, and a downstream folding roller 30 extending parallel to roller 20 and forming with it a folding nip 32. The input roller 20 extends along the paper inlet slot 34 in housing 12, and the arrangement is such that when the paper sheet 40 (FIG. 5) is manually introduced downwardly through guide 11 it will enter nip 24 and be urged forwardly into housing 12 as roller 20 is rotated clockwise in FIG. 5. Each of rollers 20 and 30 preferably comprises a central steel shaft covered with a layer of elastomeric material.

Figure 8A:
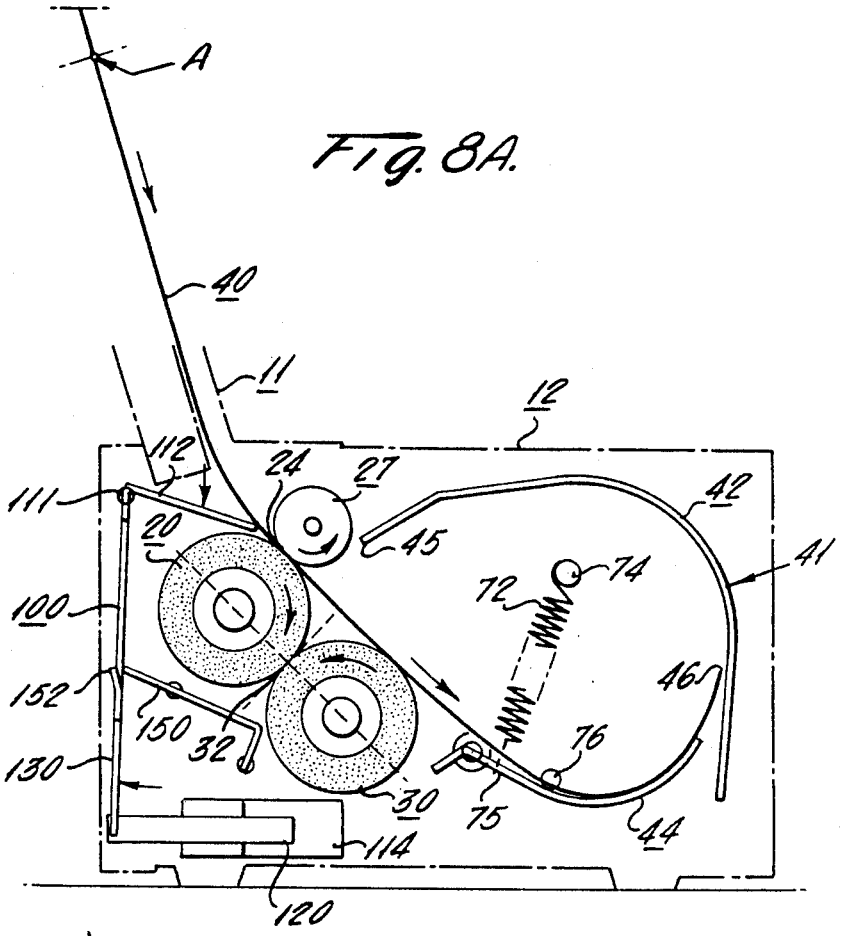
FIGS. 8A through 8E are simplified schematic views showing the progress of a sheet through the folder as it is introduced, turned back on itself, and folded into three parts.
Figure 8B:
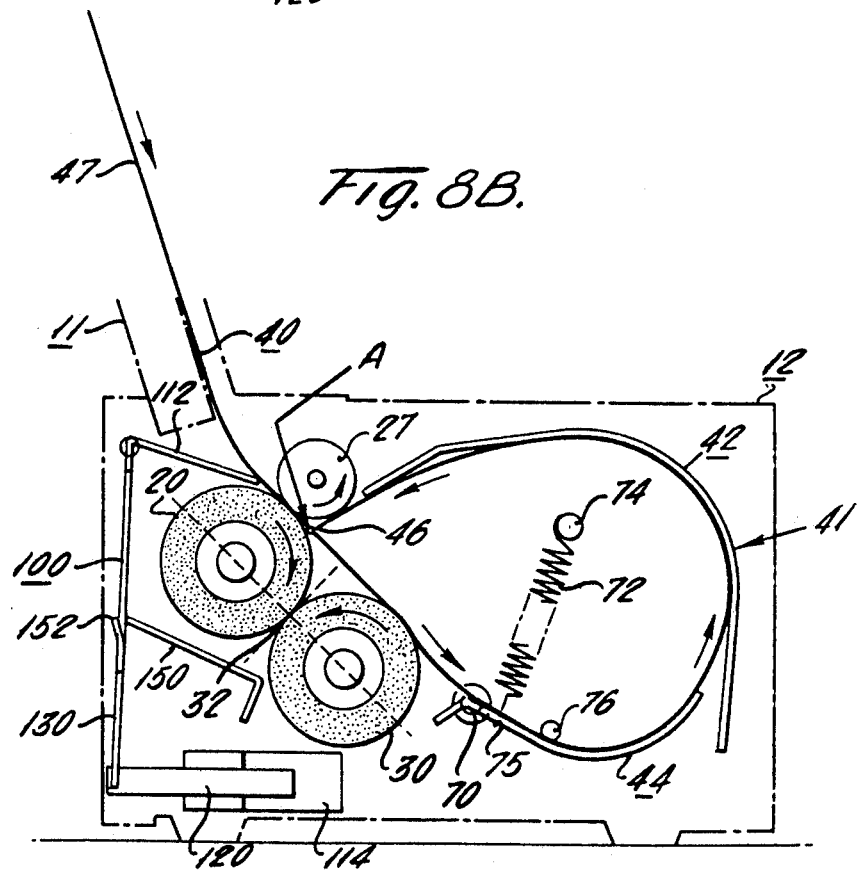

In housing 12, and extending downstream from downstream folding roller 30, is a sheet guide 41 (see FIG. 5) having a fixed portion 42 and a spring-biased, pivotable portion 44. Both portions of the guide are approximately cylindrical in the geometric sense, with cylinder axes parallel to the axes of rollers 20 and 30, but preferably they are not right cylindrical, i.e. their cross-sections are not exactly circular but instead together they provide a more nearly pear-shaped profile as shown, with the outlet edge 45 of the guide lying parallel to the axes of the rollers. The inner surface of the guide 41 is smooth so that the sheet will slide over it easily. Referring especially to FIGS. 8A–8E, the guide 41 receives the leading edge of the sheet and guides it around and back on itself until its leading edge 46 (FIG. 8C) contacts its trailing portion 47 along a line A in the sheet. As shown in FIG. 8B, just at initial contact of the leading edge 46 of the sheet with its own upstream portion 47, line A lies slightly upstream of the nip 32 formed between roller 20 and the downstream roller 30; it is understood that roller 30 rotates counterclockwise as viewed in FIGS. 5 and 8B.

Figure 8C:
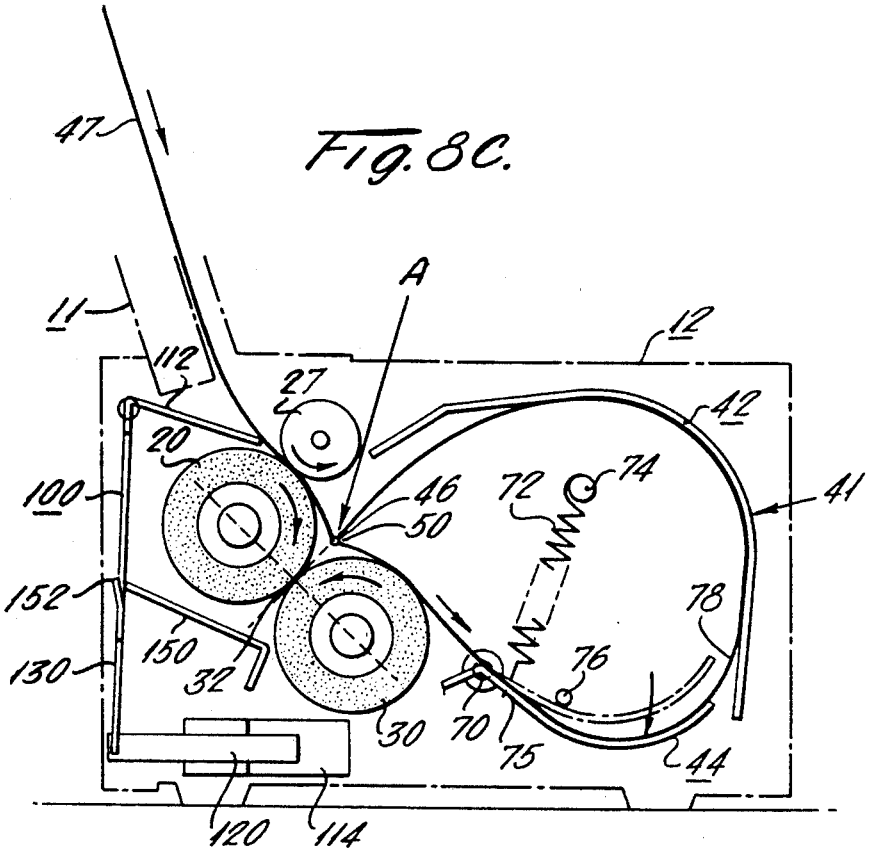
Figure 8D:
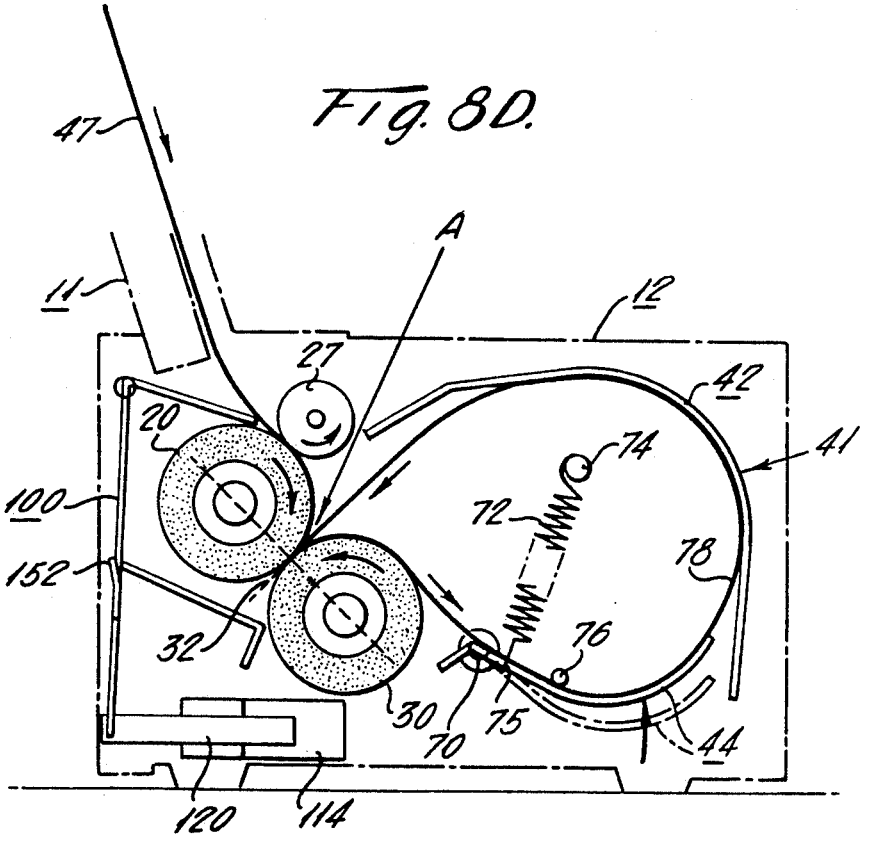
Figure 8E:
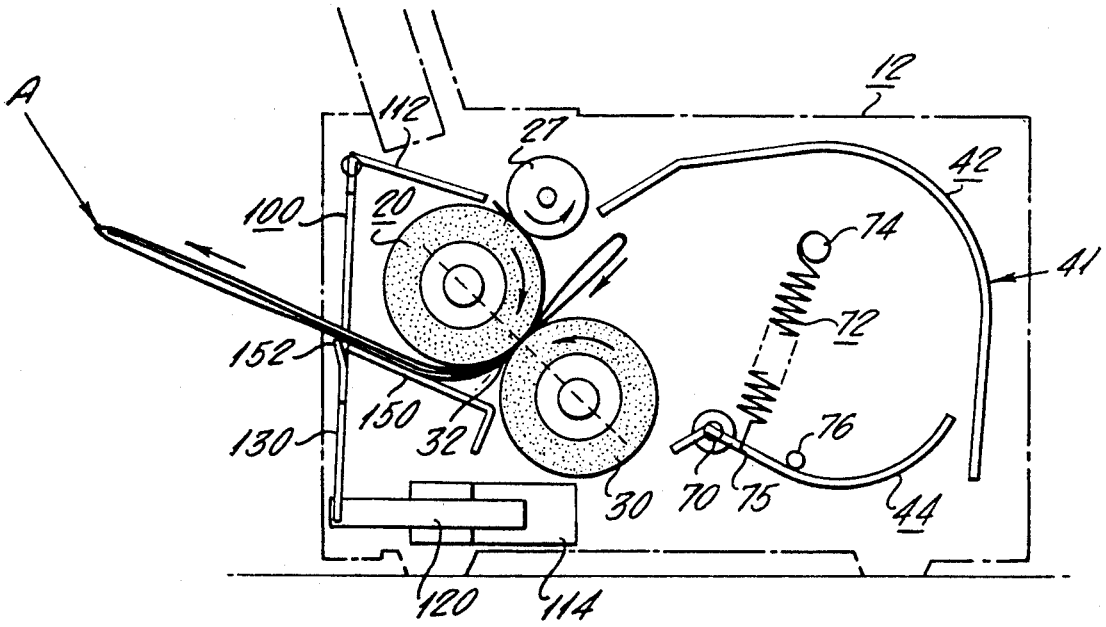

Upon continued operation beyond the position of the sheet shown in FIG. 8B, the leading edge of the sheet produces a linear dimple 50 in the sheet, along line A, and with further continued operation as shown in FIG. 8C, the line A in the sheet, with the leading edge of the sheet bearing against it, is drawn into and through nip 32 to form a first creased fold line at A, and to form the sheet then remaining in the guide into a loop which is smaller than the guide. Upon further continued operation, the latter loop is pulled through nip 32 as shown in FIG. 8E, so as to be flattened against the remaining trailing portion 47 of the sheet as the sheet exits from nip 32, thereby to complete the folding of the sheet into three sections.

The striking of the leading edge of the sheet initially against line A at a slightly obtuse angle (measured with respect to the upstream portion of the sheet) and at a point slightly upstream of nip 32 assures that when the sheet first becomes dimpled at A and is about to be forced into nip 32 as shown in FIG. 8C, the leading edge 46 of the sheet will be substantially perpendicular to the upstream portion of the sheet and aligned with nip 32, to assure entry into that nip as desired.

Figure 5:
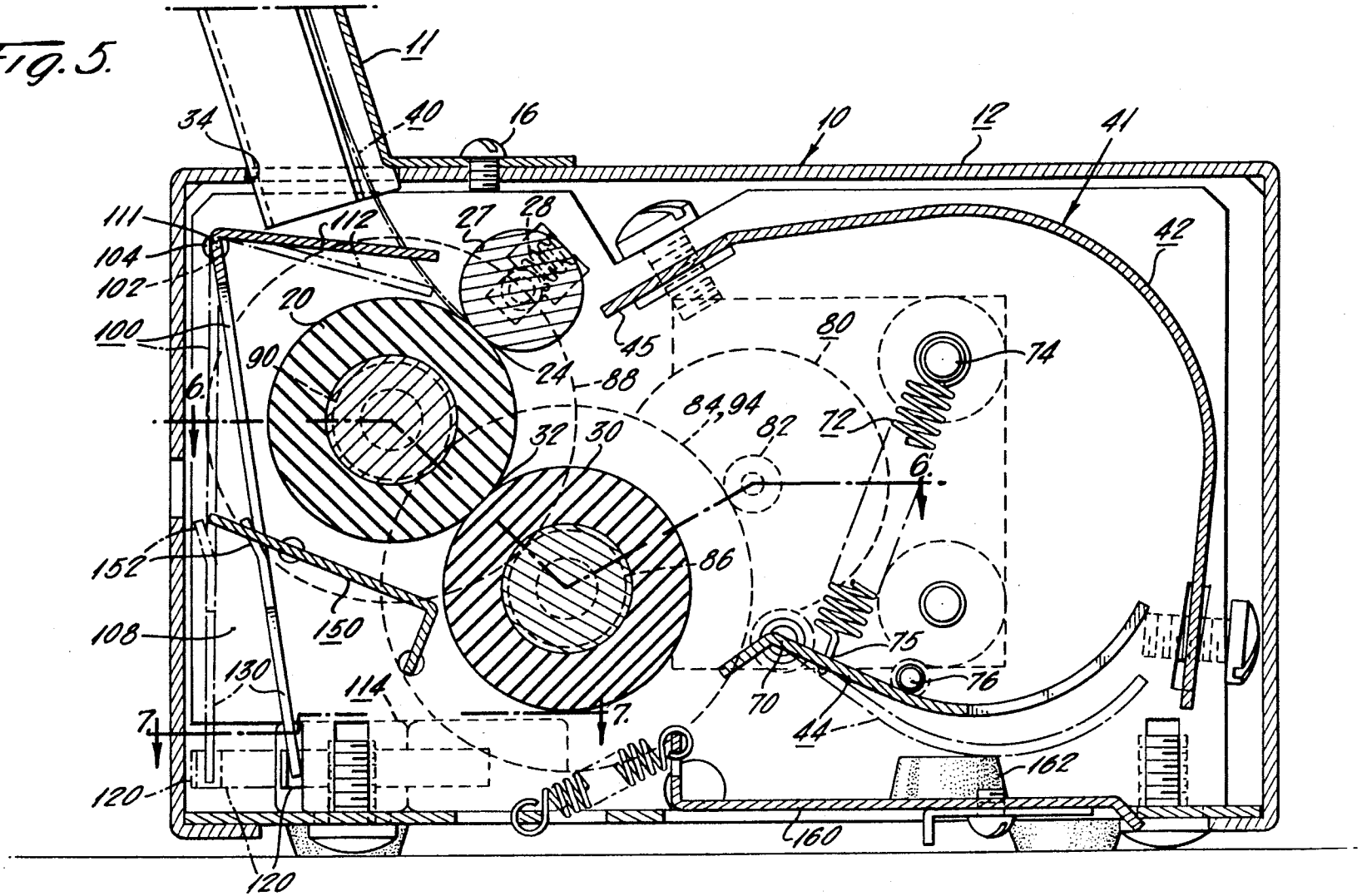
FIG. 5 is a vertical cross-sectional view taken along lines 5—5 of FIG. 3.

The pivotable portion 44 of guide 41 is mounted at its upstream edge on pivot 70, the axis of which is parallel to those of the rollers. Guide spring 72 is held at one end by post 74, its other end 75 being secured in a hole in the pivotable guide portion 44 to urge it radially inwardly of the guide. A stop 76 limits such inward motion to the position shown in FIG. 8A. Spring 72 has a strength such that, as the sheet enters the guide and proceeds around the interior of the guide prior to striking the upstream portion of the sheet, movable guide portion is not substantially deflected radially outwardly from its most inward position (FIGS. 8A and 8B). However, after the leading edge of the sheet strikes its own trailing portion 47 at line A, and the sheet continues to enter the guide, the loop 78 which the sheet forms in the guide expands, and exerts sufficient outward pressure against the movable guide portion 44 to move it outwardly against the spring tension, permitting more paper to enter the guide as the sheet begins to enter nip 32 along line A. As shown in FIG. 5, a clean-out trap door 160 is provided at the bottom of the folder, on which is mounted a bumper stop 162 limiting the outward motion of the movable guide portion 44.

Once the sheet enters nip 32, the urging of movable guide portion radially inwardly by spring 72 aids in forcing the sheet further into nip 32. Upon continued operation, the loop 78 decreases in size inside the guide, and movable portion 44 of the guide returns to its original inwardmost position.

By proportioning the guide suitably, the final sheet (or set of sheets) is folded into three equal sections suitable for insertion into a standard envelope for letters, as shown in FIG. 1.

Figure 6:
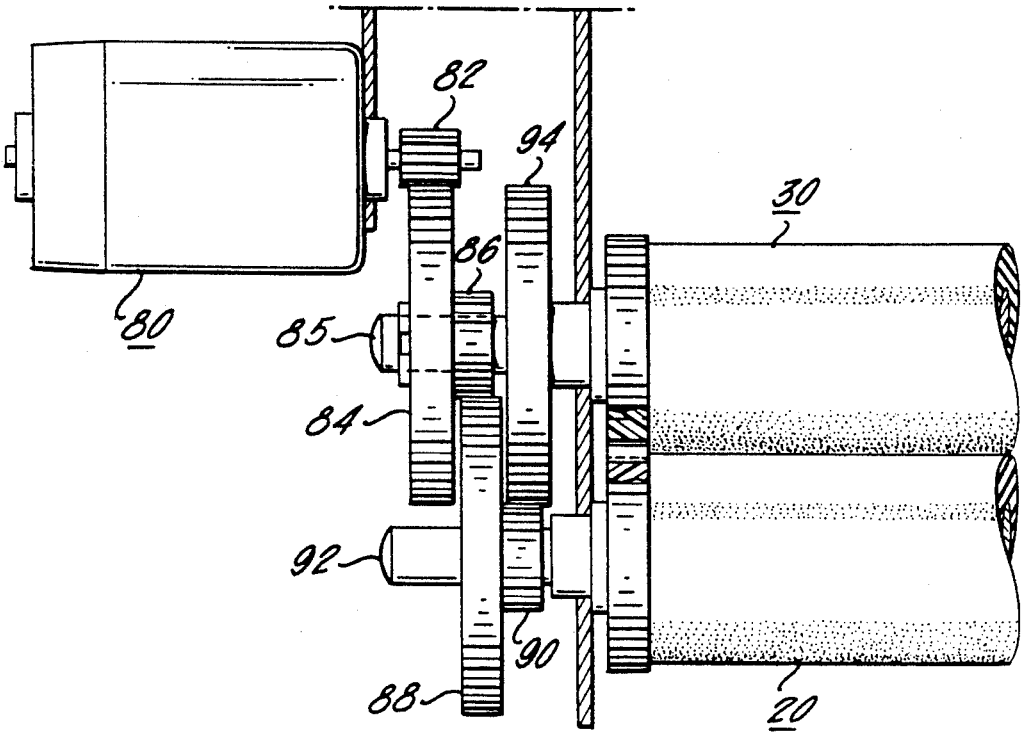
FIG. 6 is an enlarged fragmentary view of the roll- o driving mechanism in the folder of FIG. 1.

In the preferred embodiment shown, the electric motor 80 (FIG. 6) may be a 12-Volt DC motor, and drives first pinion gear 82, which engages and drives a reduction gear 84 mounted to turn on shaft 85 along with a small third gear 86 secured to turn with gear 84 on shaft 85. Gear 86 drives larger gear 88, which turns a smaller gear 90; both gears 88 and 90 turn on shaft 92. A further gear 94 fixed to drive shaft 85 is driven by gear 90 and rotates roller 30. Gear 95, fixed to shaft 85, drives gear 96, which is fixed to shaft 92 to turn roller 20.

Figure 7:
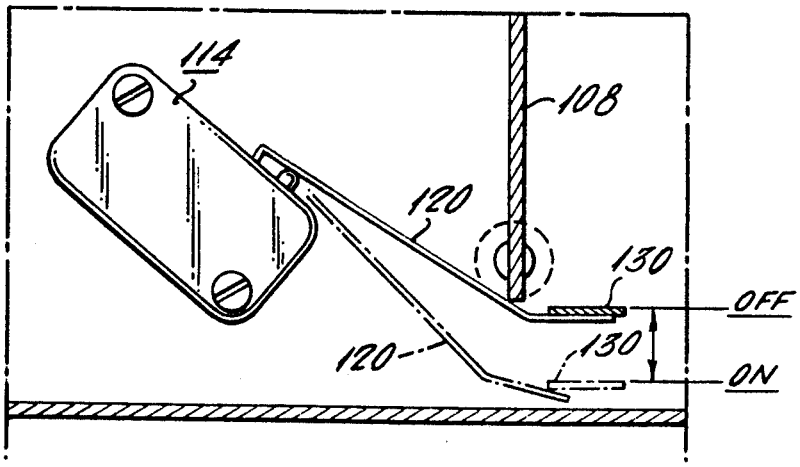
FIG. 7 is an enlarged fragmentary view, taken along lines 7—7 of FIG. 5, of the microswitch arrangement for automatically turning on and off the motor in the folder of FIG. 1.

Also, means are preferably provided for turning on the motor automatically when a sheet is inserted into the folder, and for turning it off when the fold sheet leaves the folder. In the preferred embodiment, this action is provided by pivoted mechanical sheet sensor 100 in the form of a bent-up plate having small ears 102 at its opposite ends which fit into corresponding small holes 104 in the end support plates 108 and 110. This mechanical sensor cooperates with a microswitch 114 (FIG. 7) which senses the rotational position of the mechanical sheet sensor, and opens and closes the power circuit for motor 80 to turn it on when paper is in the folder and to turn it off at other times.

More particularly, mechanical sheet sensor 100 senses both the insertion of a sheet into the folder and the exit of the folded sheet form the folder. To this end it is provided with an upper, nearly horizontal, bent portion 112 located above its pivot axis 111, positioned to be contacted and rotated clockwise in FIG. 5 when a sheet is inserted into guide 11. Sensor 100 is normally angularly biased to its OFF position (FIG. 7) when moved clockwise in FIG. 5 by the spring action of arm 120 of microswitch 114 (FIG. 7), i.e. it assumes the position shown in full line in FIG. 5 when no paper is in the folder. When a sheet 40 is introduced into the folder, the incoming sheet deflects the sensor portion 112 to the position shown in broken line in FIG. 5, thus swinging the downwardly extending portion 130 of the sensor to the position shown in broken line, thereby to operate the microswitch so as to turn on the motor 80.

After the sheet has passed into the folder, sensor 100 remains activated by the trailing portion of the sheet until after the fold line A of the sheet has passed through the nip 32 and is about to exit from the folder by way of the exit guide 150. At or slightly before this time the exiting folded end of the sheet passes over the sideways-extending tab 152 on sensor portion 130, located below the axis of pivot of the sensor, so as to hold the sensor in its clockwise actuated position, and to keep the motor on. Once the sheet has completely passed the tab 152 and has exited from the folder, the sensor is no longer actuated by the sheet and, in response to the spring in microswitch 114, the sensor is rotated counterclockwise by microswitch arm 120 to its rest position, in which the microswitch is open and the motor is off.

While the invention has been described with particular reference to specific embodiments in the interest of complete definiteness, it will be understood that it may be embodied in a variety of forms diverse from those specifically shown and described, without departing from the spirit and scope of the invention.

I claim:

1. Folder apparatus for folding a paper-like sheet, comprising:

(a) means for advancing the sheet into said folder apparatus;

(b) guide means for guiding the leading edge of said advancing sheet in a path turning back upon itself in a loop, so that said leading edge of said sheet impinges a transverse line in a trailing portion of said sheet;

(c) roller means forming a folding nip extending along and adjacent to said line;

(d) wherein said advancing means continually advances said leading edge against said line in said trailing portion of said sheet, to force into said folding nip both said leading edge of said sheet and said transverse line in said sheet, and to form a first creased fold in said sheet extending along said transverse line and containing said sheet leading edge;

(e) whereby, upon further operation, said leading edge of said sheet remains within and travels with said fold as it passes through said folding nip, and the portion of said sheet extending in a loop between said fold line and said sheet leading edge thereafter passes through said folding nip to form a second creased fold, thereby folding said sheet into said three sections.

2. The apparatus of claim 1, wherein said transverse line is located about two-thirds of the way from said leading edge to the trailing edge of said sheet.

3. The apparatus of claim 1, wherein a portion of said guide means is pivotably mounted and spring-biased radially inwardly of said loop, so as to move outwardly in response to pressure from said sheet when said sheet has advanced into and around said guide and into contact with said transverse line, and thereafter to move inwardly again as the sheet moves through said folding nip, thereby to assist in forcing said leading edge and said transverse line into and through said folding nip.

4. The apparatus of claim 1, wherein said roller means comprises an upstream roller and a downstream roller adjacent each other to form said folding nip, and an inlet roller adjacent said upstream roller for forming an inlet sheet- o feeding nip for feeding said sheet into said folder.

5. The apparatus of claim 4, wherein said guide means comprises a first portion pivotable to move radially of said loop, and a second portion which is stationary.

6. The apparatus of claim 1, comprising mechanical sensor means for sensing when said sheet is in said folder, motor means for operating said roller means, and microswitch means operated by said mechanical sensor means to turn said motor on when a sheet is in said folder and off when said sheet has left said folder.

7. The apparatus claim 6, wherein said mechanical sensor comprises a bent-up plate having a pair of ears at opposite ends for supporting it pivotably in said folder and having a first portion extending into the path of said sheet upstream of said roller means to turn said sensor away from its rest position in one sense in response to said sheet, and having a depending portion with a laterally extending ear adjacent to the exit from said folder positioned to turn said sheet also in said one direction in response to said sheet, whereby said mechanical sensor is held in an actuated rotary position when said sheet is in said folder, said sensor in said actuated position pivoting said microswitch means to turn on said motor, said sensor in the absence of said sheet returning to its rest position in which it causes said microswitch to shut off said motor.

* * * * *